United States Patent [19]

Arent

[11] Patent Number: 4,624,088

[45] Date of Patent: Nov. 25, 1986

[54] FLUSH MOUNTED SUSPENDED CEILING SYSTEM

[76] Inventor: Gordon R. Arent, 48 Brothers Rd., Wappingers Falls, N.Y. 12590

[21] Appl. No.: 769,688

[22] Filed: Aug. 27, 1985

[51] Int. Cl.[4] ..... E04B 5/52

[52] U.S. Cl. ..... 52/484

[58] Field of Search ..... 52/484, 680, 476, 632, 52/664–667; 248/57

[56] References Cited

U.S. PATENT DOCUMENTS

| | | | |
|---|---|---|---|
| 1,982,565 | 11/1934 | Barge . | |
| 2,020,407 | 11/1935 | Forster | 52/680 |
| 2,670,919 | 3/1954 | Esoldi | 52/632 |
| 2,689,630 | 9/1954 | Drury | 52/485 |
| 2,713,983 | 7/1955 | Kay | 248/57 |
| 3,004,644 | 10/1961 | Hull . | |
| 3,332,191 | 7/1967 | Fischer . | |
| 3,333,387 | 8/1967 | Deakins | 52/484 |
| 3,418,766 | 12/1968 | Jackson . | |
| 3,596,425 | 8/1971 | Kodaras | 52/476 |
| 3,861,105 | 1/1975 | Starks . | |
| 3,995,823 | 12/1976 | Hensel . | |
| 4,438,613 | 3/1984 | Hintsa et al. . | |

FOREIGN PATENT DOCUMENTS

| | | |
|---|---|---|
| 1465497 | 12/1967 | France . |
| 108800 | 10/1961 | Norway . |

*Primary Examiner*—James L. Ridgill, Jr.

*Attorney, Agent, or Firm*—Watson, Cole, Grindle & Watson

[57] ABSTRACT

Disclosed is a suspended ceiling support system which provides a ceiling which is essentially flush with its supporting members. The support system attaches to the lower surfaces of joists forming part of a floor and supports a plurality of ceiling tiles. The system comprises a plurality of elongated support members extending between adjacent joists, the support members being located in at least one row, at least one main tee runner extending parallel to the row of support members, at least two wishbone-shaped springs attached to the main tee runner and which each extend through an aperture in a support member such that the main tee runner can be supported in at least two positions relative to the support member, and at least two cross-tee runners extending perpendicular to the main tee runner, one end of each cross tee runner being supported on the main tee runner whereby the cross-tee runners and main tee runner are capable of supporting at least one ceiling tile. By virtue of this design, the ceiling can be lowered for insertion or removal of ceiling tiles, and raised upwardly to position the finished ceiling firmly against its supporting surfaces.

10 Claims, 7 Drawing Figures

FLUSH MOUNTED SUSPENDED CEILING SYSTEM

The present invention relates generally to systems for making a suspended ceiling and, more particularly, to such system which provide a ceiling which is essentially flush with its supporting surface.

BACKGROUND OF THE INVENTION

Conventional systems for providing a suspended ceiling generally comprise a plurality of main runners arranged parallel to each other and a plurality of cross runners arranged parallel to each other and perpendicular to the main runners to provide a grid pattern of square open apertures. Both the main runner and cross runners are of an inverted tee cross-section such that the horizontal portion of the runners are able to support a ceiling tile about its periphery. At least the main runners are secured a fixed distance below the bottom of floor joists by hangers which extend between the joists and the vertical portions of the runners.

To install ceiling tiles in such a system, the tiles are tilted, inserted upwardly through one of the apertures in the grid, and then adjusted to the horizontal plane and allowed to drop into place between the main runners and cross runners. This procedure must be reversed to remove tiles for replacement or repair. As a consequence, the grid runners must be spaced beneath the joists a sufficient distance, e.g., at least three inches, to allow for the insertion and removal of the ceiling tiles. For rooms such as basement or attic rooms where headroom is typically quite limited, the installation of a conventional suspended ceiling system even further reduces the headroom, often to an unacceptable level.

SUMMARY OF THE INVENTION

It is therefore a feature of the subject invention to provide a suspended ceiling system which enables the ceiling to be essentially flush with the joists of a floor forming the ceiling support.

It is another feature of the present invention to provide a suspended ceiling system which is capable of being lowered so as to allow for the removal of ceiling tile for purposes of, among other things, replacement and/or repair of the tile.

It is yet another feature of the present invention to provide a suspended ceiling system which is easily installed and supplies a steady and firm support for the ceiling tiles.

Briefly, the present invention in its broader aspects comprehends a ceiling support system for attachment to the lower surfaces of joists forming part of a floor and adapted to support a plurality of ceiling tiles, the system comprising a plurality of elongated support members extending between adjacent joists, said support members being located in at least one row and having at least one aperture therein, at least one main tee runner extending parallel to the row of support members, at least two wishbone shaped springs attached to the main tee runner and which each extend through an aperature in a support member such that the main tee runners can be supported in at least two positions relative to the support member, and at least two cross-tee runners extending perpendicular to the main tee runner, one end of each cross tee runner being supported on a main tee runner whereby the cross-tee runners and main tee runners are capable of supporting at least one ceiling tile.

Further objects, advantages and features of the present invention will become more fully apparent from a detailed consideration of the arrangement and construction of the constituent parts as set forth in the following description taken together with the accompanying drawing.

DETAILED DESCRIPTION OF THE PREFERRED EMBODIMENT

Figure 1:
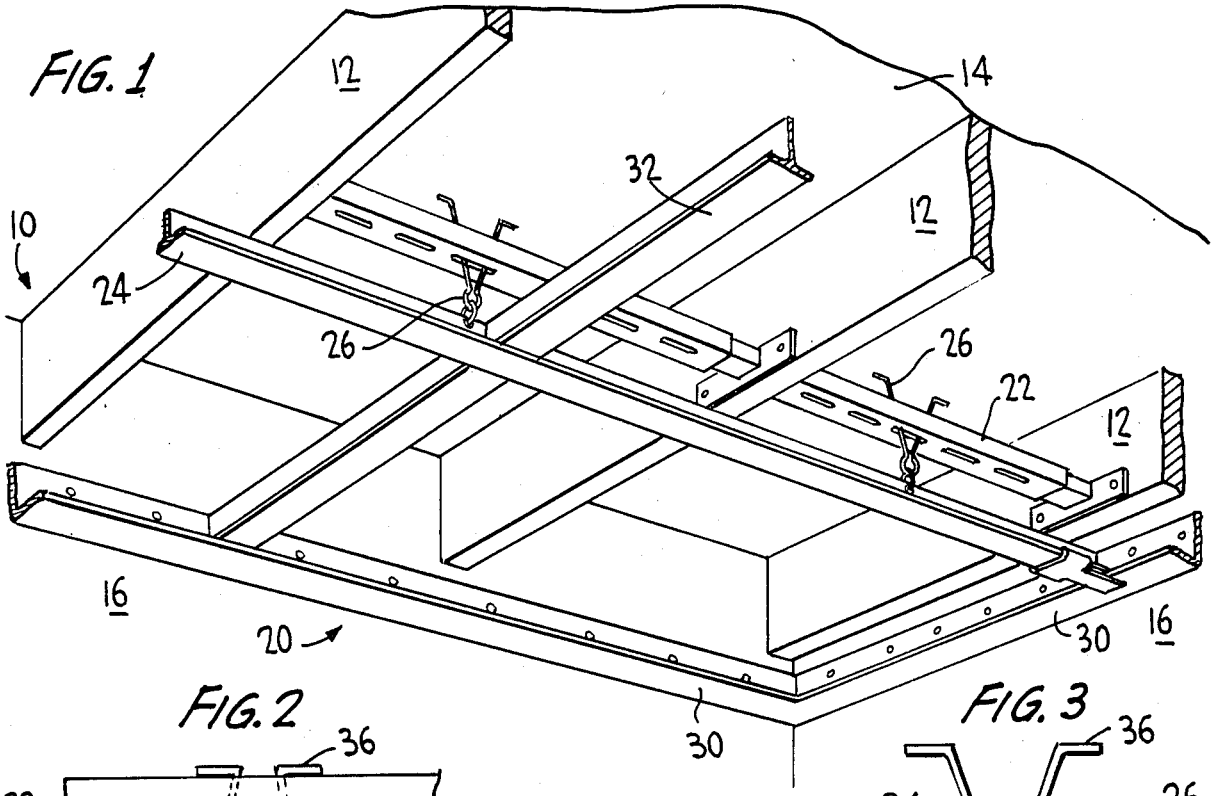
FIG. 1 is a perspective view of a portion of the suspended ceiling system of the present invention shown installed beneath a joist type floor.

Referring now to FIG. 1, shown is a perspective view of lower portion of floor 10 having a suspended ceiling system 20 according to the present invention installed therebeneath. In this embodiment of the invention, floor 10 is the type commonly found in the basement of many residential homes and includes a plurality of parallel, horizontally extending joists 12 with sub-floor 14 thereover. Supporting walls 16 extend downwardly from ceiling 10.

Suspended ceiling system 20 attached to joists 12 of floor 10 comprises support members 22 extending between and perpendicular to the joists. Support members 22 are securely attached to joists 12 by any suitable means such as nails. Support members 22 are generally arranged in a plurality of rows with the spacing between adjacent rows being approximately equal to a major dimension of a ceiling tile (not shown) to be used in forming the suspended ceiling.

Suspended from a row of support members 22 is main tee runner 24 which may extend across the entire width or length of the room. Main tee runner 24 is connected to each support member 22 in the row by wishbone-shaped spring 26 which is attached to the main runner at one end and extends through slot 28 (See FIG. 7) in support member 22. The ends of main tee runners 24 are supported by angle wall molding 30 extending about the periphery of floor 10 and attached to wall 16. The horizontal support surface of angle wall molding 30 is spaced below joists 12 a distance approximately equal to the height of main tee runner 24. Angle wall molding 30 is secured to wall 16 by screws, nails or the like.

Extending perpendicular to main tee runners 24 are parallel rows of cross-tee runners 32, the cross tee runners being supported by the horizontal flange of the main tee runners. The rows of cross tee runners 32 are spaced from each other a distance approximately equal to the other main dimension of the ceiling tile to be used with the ceiling system to form a suspended ceiling. Like main tee runner 24, the ends of a cross-tee runner 32 which extend to wall 16 are supported by angle wall molding 30.

Figure 2:
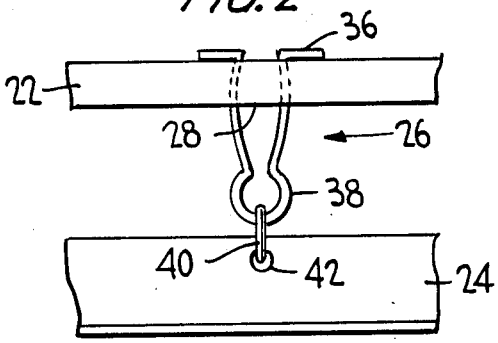
FIG. 2 is a detailed view of a portion of the suspended ceiling system, the portion shown in the lowered position.
Figure 3:
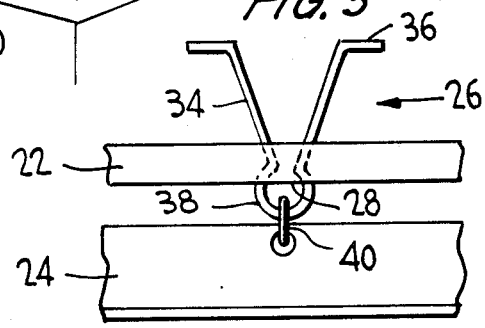
FIG. 3 is a detailed view of a portion of the suspended ceiling system, the portion shown in the raised position.

FIGS. 2 and 3 illustrate how suspended ceiling system 20 is lowered to facilitate insertion of ceiling tile. In FIG. 2, legs 34 of wishbone-shaped spring 26 have been compressed together such that the spring is pulled down through slot 28 in support member 22 such that main tee runner 24 is lowered relative to the support member. Feet 36 on spring 26 prevent the spring from being removed from slot 28 and also support main tee runner 24 in its lowered position. In FIG. 3, main tee runner 24 has been pushed upwardly and head 38 of spring 26 contacts slot 28 of support member 22. The spring bias of legs 34 maintains main tee runner 24 in this position relative to support member 22. Spring 26 may be attached to main tee member 24 by any suitable means such as wire 40 passing through head 38 and aperture 42 in the main tee member.

Figure 4:
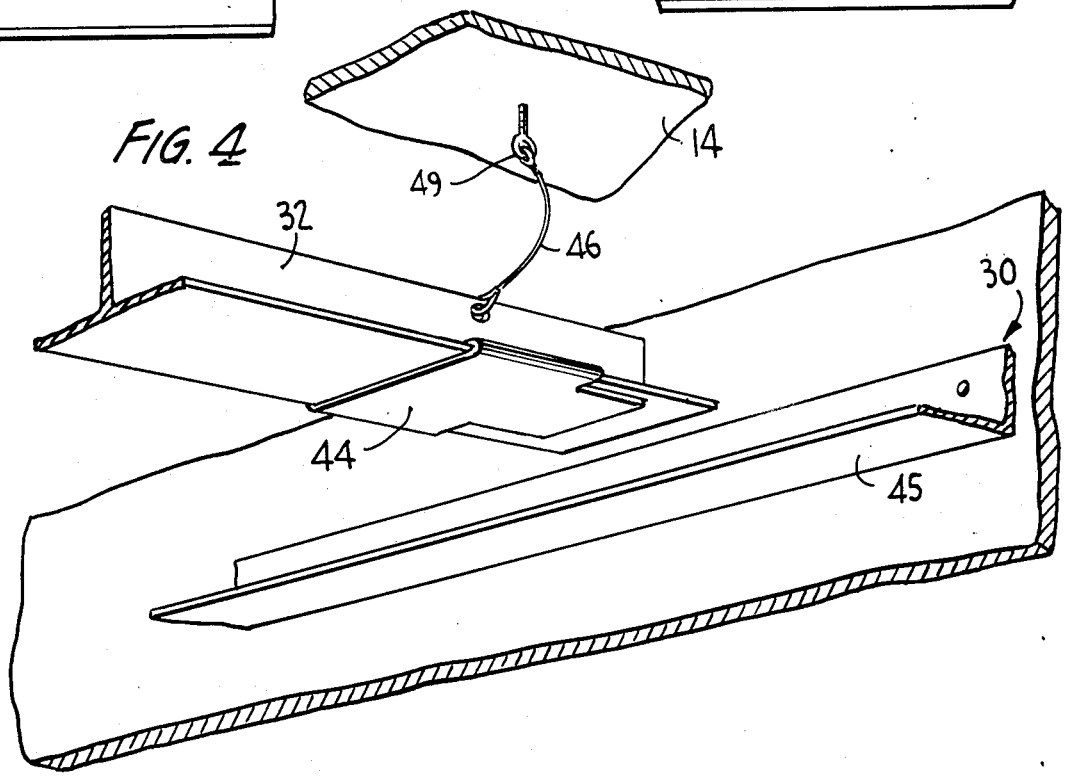
FIG. 4 is a perspective view of one embodiment cross tee runner having a slide capable of engaging an angle wall molding of the ceiling system.
Figure 5:
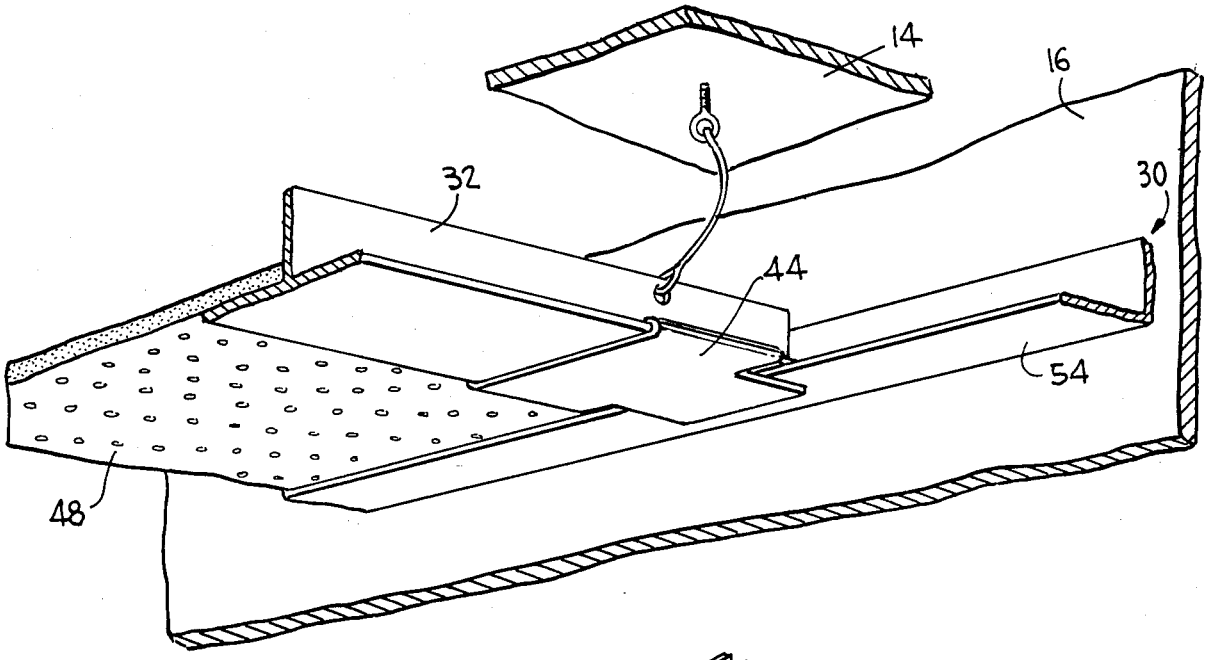
FIG. 5 is a perspective view similar to FIG. 4 showing a slide on the end of cross tee runner engaging the angle wall molding as well as showing an installed ceiling tile.
Figure 6:
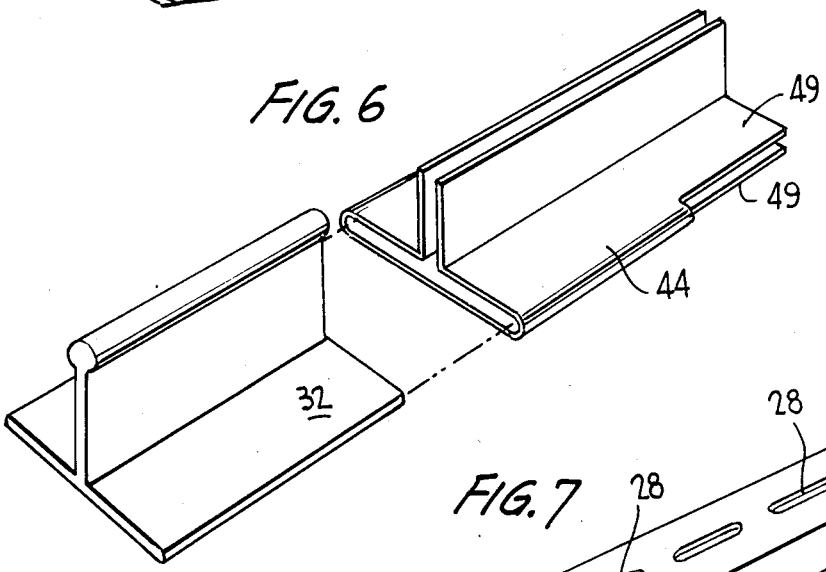
FIG. 6 is a perspective view of a cross tee runner illustrating the slide for engaging the runner to an angle wall molding, and, FIG. 7 is a perspective view of a support member of the suspended ceiling system.

FIGS. 4 through 6 illustrate one means by which the ends of cross tee members 32 may be supported by angle wall molding 30. In this embodiment, cross tee runner 32 is provided with slide 44 which can be used to increase or extend the length of the cross tee runner. Thus, cross tee runner 32 would be made to be of a length to extend just to outer extremity of horizontal flange portion 45 of angle molding 30 and slide 44 would be used to increase its effective length such that it could be supported by the molding. Similar slides 44 could be provided on each end of main tee runners 24 such that their effective length could be increased so as to allow easy assembly between opposing portions of angle wall molding 30.

In the embodiment depicted in FIGS. 4 and 5, flexible member 46 is attached to cross tee runner 32 and to eyebolt 49 secured to subfloor 14. Flexible member 44 is of such length that the free end of cross tee runner 32 is supported when the system 20 is in the lowered position. Flexible member 46 may be a cord, wire or the like.

FIG. 5 illustrates slide 44 in its extended position on cross tee runner 32 such that the runner is supported by flange portion 45 of angle wall molding 30. FIG. 5 also illustrates installed ceiling tile 48 as would be supported by system 20.

FIG. 6 is a perspective view of the end portion of cross tee runner 32 and of slide 44 showing how the slide engages the cross tee runner. End portion 49 of slide 44 includes two parallel surfaces which are adapted to contact the upper and lower horizontal surfaces of angle wall molding to prevent slide and thus cross tee runner from being displaced in the vertical direction.

Figure 7:
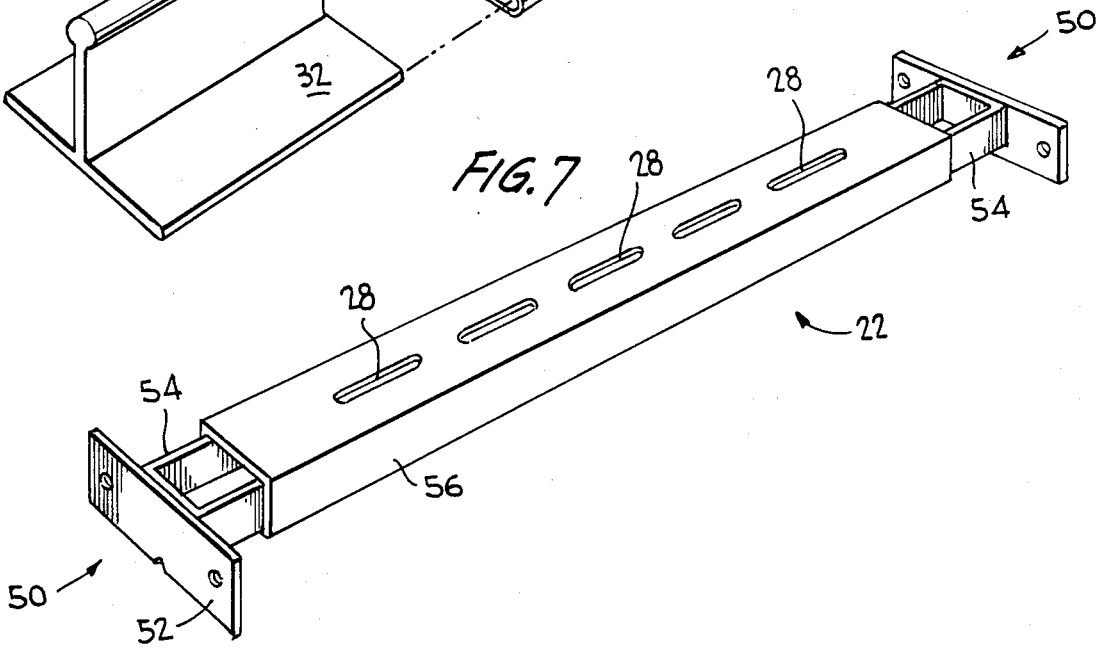

FIG. 7 is a perspective view of one embodiment of support member 22 for use in the subject ceiling system. Support member 22 comprises two end pieces 50 each including mounting plate 52 having mounting apertures therein, the plate being adapted to contact the vertical side surface of joist 12. End piece 50 also includes blade-shaped projections 54 slidable engaging the interior of partially enclosed channel 56. With such a construction for support member 22, the member is adjustable in length to a certain degree and thus is adapted to be installed in ceilings having different joist spacings. As was mentioned previously, channel 54 includes a plurality of slots 28 through which spring 26 is adapted to extend. By providing a plurality of slots 28, proper alignment of spring 26 in the attachment of main tee runner 24 to support member 22 is facilitated.

To install suspended ceiling system 20 of the invention, support members 22 are affixed between joists 12 in a plurality of rows spaced in accordance with the size of the ceiling tile to be utilized. Prior to, or subsequent to, the installation of support members 22, angle wall molding 30 is secured to walls 16 around the entire periphery of floor 10. Main tee runners 24 with springs 26 attached are then connected to support members 22 by squeezing legs 34 together and inserting feet 36 through slots 28 in the support members. Main tee runners 24 and spring 26 should then be in the position illustrated in FIG. 2.

Cross tee runners 32 are positioned perpendicular to main tee runners 24 and installed such that their ends are supported by the horizontal flange portion of the main tee runners. Rows of cross tee runners 32 are formed, the rows spaced from each other according to dimension of ceiling tiles 48 to be installed. Flexible member 46 is used to support the ends of those cross tee runners 32 adjacent to walls 16. Ceiling tiles 48 are then placed on the suspended ceiling system 20 such that the edges of the tiles are supported by the horizontal flanges of main tee runners 24 and cross tee runners 32.

Once all tiles 48 are in place, ceiling system 20 is forced upwardly such that main tee runners 24 and springs 26 assume the position shown in FIG. 3. Thereafter, slides 44 on the ends of main tee runners 24 and cross tee runners 32 are adjusted such that the ends of the runners are supported by angle wall molding 30.

As is apparent from the foregoing, suspended ceiling system 20 according to the invention provides a ceiling which is essentially flush with the lower portions of supporting floor 10. Thus, system 20 is particularly advantageous in providing a finished ceiling in rooms such as basements, attics and the like having limited headroom. Furthermore, system 20 is easy to install and provides a firm and stable support for the ceiling tiles. In addition, the removal or repair of selected ceiling tiles can be accomplished rather easily by simply lowering ceiling system 20 in the reverse manner of installation.

While there has been shown and described what is considered to be preferred embodiments of the present invention, it will be obvious to those skilled in the art that various changes and modifications may be made therein without departing from the invention as defined in the appended claims.

It is claimed:

1. A suspended ceiling support system for attachment to the lower surfaces of joists forming part of a ceiling and adapted to support a plurality of ceiling tiles, the system comprising a plurality of elongated support members extending between adjacent joists, said support members being located in at least one row, at least one main tee runner extending parallel to the row of support members, at least two wishbone-shaped springs attached to the main tee runner and which each extend through and engage an aperture in a support member such that the main tee runner can be selectively supported in at least two different vertical positions relative to the support member, and at least two cross-tee runners extending perpendicular to the main tee runner, one end of each cross tee runner being supported on the main tee runner whereby the cross-tee runners and main tee runners are capable of supporting at least one ceiling tile.

2. A suspended ceiling support system in accordance with claim 1, wherein the support members are adjustable in length and capable of being aligned over predrilled mounting holes in the main tee runners.

3. A suspended ceiling support system in accordance with claim 1, wherein the wishbone-shaped spring comprises a head portion, two legs extending from the head, and a foot at the end of each leg.

4. A suspended ceiling support system in accordance with claim 3, wherein said head portion of the spring is generally circular and the feet are in a common plane.

5. A suspended ceiling support system in accordance with claim 1, further including wall angle molding about the periphery of the floor, ends of some of the cross tee runners and ends of the main tee runners being supported by the wall angle molding.

6. A suspended ceiling support system in accordance with claim 5, wherein ends of the main tee runners supported by the angle wall molding include a slide.

7. A suspended ceiling support system in accordance with claim 5, wherein ends of the cross-tees runners supported by the angle wall molding include a slide.

8. A suspended ceiling support system in accordance with claim 7, wherein ends of the main tee runners supported by the angle wall molding include a slide.

9. A suspended ceiling support system in accordance with claim 5, wherein the end of the cross tee members supported by the wall angle molding are attached to the floor by a flexible member.

10. A suspended ceiling support system in accordance with claim 9, wherein the support member comprises a channel and two end pieces, each end piece comprising a mounting plate and a projection therefrom which is slidably contained within an end of the channel.

* * * * *